US008801149B2

(12) United States Patent
Suzuki et al.

(10) Patent No.: US 8,801,149 B2
(45) Date of Patent: Aug. 12, 2014

(54) METHOD OF MANUFACTURING FLOW PATH MEMBER, FLOW PATH MEMBER, LIQUID EJECTING HEAD AND LIQUID EJECTING APPARATUS

(75) Inventors: Shigeki Suzuki, Shiojiri (JP); Hiroshige Owaki, Okaya (JP); Hiroyuki Kobayashi, Azumino (JP); Hiroyuki Ishii, Shiojiri (JP)

(73) Assignee: Seiko Epson Corporation (JP)

( * ) Notice: Subject to any disclaimer, the term of this patent is extended or adjusted under 35 U.S.C. 154(b) by 38 days.

(21) Appl. No.: 13/556,688

(22) Filed: Jul. 24, 2012

(65) Prior Publication Data

US 2013/0025701 A1 Jan. 31, 2013

(30) Foreign Application Priority Data

Jul. 25, 2011 (JP) ..... 2011-162619

(51) Int. Cl.
*B41J 2/05* (2006.01)
*B41J 2/175* (2006.01)

(52) U.S. Cl.
USPC ..... 347/65; 347/85

(58) Field of Classification Search
None
See application file for complete search history.

(56) References Cited

FOREIGN PATENT DOCUMENTS

JP 2008-018625 * 1/2008 ..... B41J 2/175

* cited by examiner

*Primary Examiner* — Geoffrey Mruk
(74) *Attorney, Agent, or Firm* — Harness, Dickey & Pierce, P.L.C.

(57) ABSTRACT

A method of manufacturing a flow path member includes inserting the first flow path member into each concave portion of the second flow path member and welding the first flow path member and the second flow path member in a circumferential direction of a region where the first flow path and the second flow path communicates each other; and providing two or more injecting portions which are provided with a gap wider than a gap between a wall surface of the concave portion which faces the first flow path member and a circumference surface of the first flow path member inserted into each concave portion which faces the wall surface, communicate with each concave portion, and are opened to the same side as the concave portion to have a concave shape to each concave portion in the second flow path member.

10 Claims, 5 Drawing Sheets

METHOD OF MANUFACTURING FLOW PATH MEMBER, FLOW PATH MEMBER, LIQUID EJECTING HEAD AND LIQUID EJECTING APPARATUS

BACKGROUND

1. Technical Field

The present invention relates to a method of manufacturing a flow path member having a flow path in which liquid flows, a flow path member, a liquid ejecting head and a liquid ejecting apparatus.

2. Related Art

As an ink jet type recording head which is an example of a liquid ejecting head, there is an ink jet type recording head including a flow path member which is connected to a liquid reservoir which stores ink directly or through a tube, and a head main body to which ink is supplied from the flow path member and which discharges ink drops from a nozzle opening.

As the flow path member, a flow path member in which a first flow path member (an ink supply needle) and a second flow path member (a filter assembly) are fixed through adhesion by welding and an adhesive has been proposed (for example, refer to JP-A-2008-18625).

It is possible to weaken energy of ultrasonic vibration which performs welding and suppress foreign substances from being generated by fixing the first flow path member and the second flow path member with welding and the adhesive, and even though the first flow path member and the second flow path member are fixed by weak welding, the adhesive is also used to rigidly fix the first and second flow path members. Therefore, ink leakage can be suppressed.

However, when the first flow path member and the second flow path member adhere each other, a syringe which applies the adhesive is moved along a boundary between the first flow path member and the second flow path member to apply the adhesive. This makes the syringe move frequently and there is a concern that the adhesive may be attached to an extra region by contact of the syringe with the first flow path member or the second flow path member. When the adhesive is applied along the boundary between the first flow path member and the second flow path member, it is difficult to suppress an amount of the adhesive. Therefore, there is a concern that the adhesive may leak into the extra region.

In particular, when other flow path members are provided on a surface opposite to the other of any one of the first flow path member and the second flow path member, the adhesive attached to the extra region is an obstacle and causes a problem that positioning of other flow path members cannot be performed, and defects that a gap is generated and liquid such as the ink intrudes from an unexpected region.

Such problems are not limited to a flow path member used in a liquid ejecting head represented as an ink jet type recording head, and also caused in a flow path member used in other devices.

SUMMARY

An advantage of some aspects of the invention is to provide a method of manufacturing a flow path member which is capable of suppressing an adhesive from being attached to an extra region and leaking, a flow path member, a liquid ejecting head and a liquid ejecting apparatus.

According to an aspect of the invention, there is a provided a method of manufacturing a flow path member which includes a first flow path member which has a first flow path and a second flow path member where a second flow path which communicates with the first flow path and each concave portion in which the first flow path is inserted and fixed are provided, the method including inserting the first flow path member into each concave portion of the second flow path member and welding the first flow path member and the second flow path member in a circumferential direction of a region where the first flow path and the second flow path communicate with each other; and providing two or more injecting portions which are provided with a gap wider than a gap between a wall surface of the concave portion which faces the first flow path member and a circumference surface of the first flow path member which is inserted into each concave portion and which faces the wall surface, communicate with each concave portion and are opened to the same side as the concave portion to have a concave shape to each concave portion in the second flow path member and injecting an adhesive into the injecting portion to be filled with the adhesive in a circumferential direction of the outside of the welded region and along a boundary between the first flow path member and the second flow path member and adhere the first flow path member and the second flow path member each other.

According to the aspect of the invention, since the first flow path member and the second flow path member are fixed by the welding and the adhesive, foreign substances can be suppressed from being generated by relatively weak welding and the first flow path member and the second flow path member can be rigidly fixed to each other by adhesion of the adhesive, even by the relatively weak welding.

By injecting the adhesive from the injecting portion apart from the first flow path member, the movement of the syringe is reduced in comparison with a case that a syringe is moved along the boundary between the first flow path member and the second flow path member to apply the adhesive. Therefore, it is possible to suppress the syringe from contacting with the second flow path member to attach the adhesive to an unexpected region. Furthermore, since the adhesive fills the concave injecting portion and the concave portion, the leakage to the surface opposite to the first flow path member of the second flow path member can be suppressed. By providing two or more injecting portions, it is possible to be certainly filled with the adhesive in a circumferential direction of the outside of the welded region and along the boundary between the first flow path member and the second flow path member.

According to another aspect of the invention, there is provided a flow path member including a first flow path member which has a first flow path; and a second flow path member where a second flow path which communicates with the first flow path, and each concave portion in which the first flow path member is inserted and fixed are provided. At least two or more injecting portions are provided with a gap wider than a gap between a wall surface of the concave portion which faces the first flow path member and a circumference surface of the first flow path member which is inserted into each concave portion, and which faces the wall surface, communicate with each concave portion and are opened to the same side as the concave portion to have a concave shape are provided to one concave portion in the second flow path member, and the first flow path member and the second flow path member are welded in a circumferential direction of a region where the first flow path and the second flow path communicate with each other, and are adhered by an adhesive outside the welded region in the concave portion.

According to the aspect, since the first flow path member and the second flow path member are fixed by the welding and the adhesive, foreign substances can be suppressed from being generated by relatively weak welding and the first flow path member and the second flow path member can be rigidly fixed to each other by adhesion of the adhesive, even by the relatively weak welding. Therefore, it is possible to suppress liquid from leaking from the fixed portion of the first flow path member and the second flow path member.

By injecting the adhesive from the injecting portion apart from the first flow path member, the movement of the syringe is reduced in comparison with a case that a syringe is moved along the boundary between the first flow path member and the second flow path member to apply the adhesive. Therefore, it is possible to suppress the syringe from contacting with the second flow path member to attach the adhesive to an unexpected region. Furthermore, since the adhesive fills the concave injecting portion and the concave portion, leakage to the surface opposite to the first flow path member of the second flow path member can be suppressed. By providing two or more injecting portions, it is possible to be certainly filled with the adhesive in a circumferential direction of the outside of the welded region and along the boundary between the first flow path member and the second flow path member.

In the flow path member, it is preferable that the volume of the injecting portion be larger than the volume of the adhesive. According to this, when the adhesive is injected to the injecting portion, the adhesive can be suppressed from overflowing from the injection portion.

In the flow path member, it is preferable that the injecting portion be provided at a position where a region where the first flow path member and the second flow path member are welded is set as the center to be symmetrical. According to this, it is possible to be certainly filled with the adhesive in the circumferential direction of the outside of the welded region and along the boundary between the first flow path member and the second flow path member.

According to still another aspect of the invention, there is provided a liquid ejecting head which includes the flow path member.

According to the aspect, it is possible to realize the liquid ejecting head which suppresses defects due to liquid leakage and liquid intrusion into the flow path member.

According to still another aspect of the invention, there is provided a liquid ejecting apparatus which includes the flow path member.

According to the aspect, it is possible to realize the liquid ejecting apparatus which suppresses defects due to liquid leakage and liquid intrusion into the flow path member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
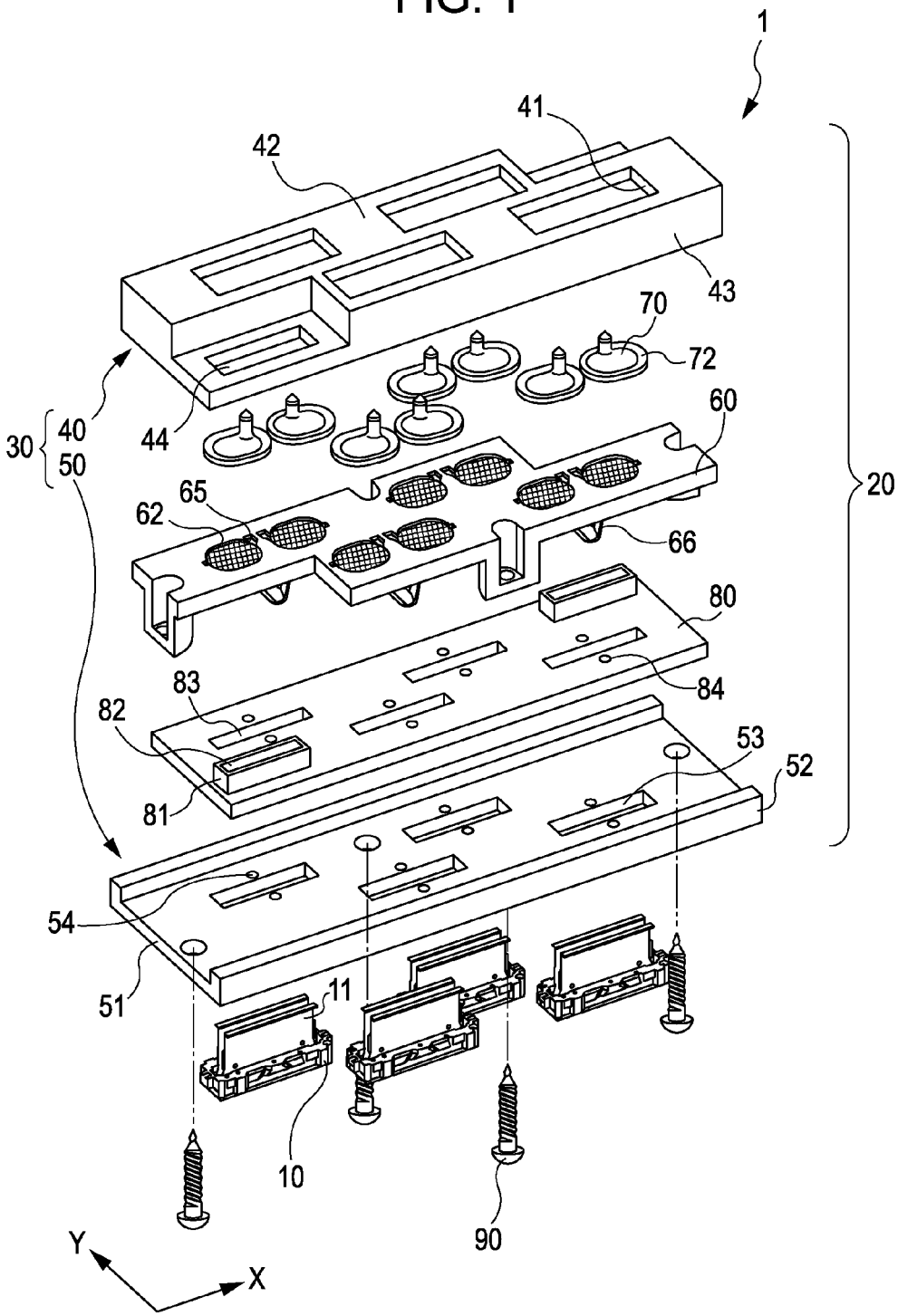
FIG. 1 is an exploded perspective view of a recording head according to Embodiment 1 of the invention.
Figure 2A:
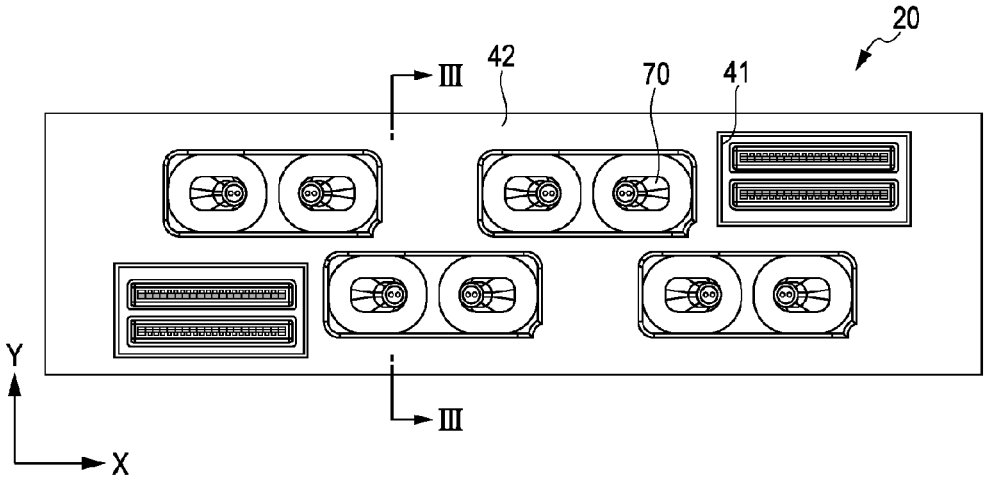
FIG. 2A is a plan view of the recording head according to Embodiment 1 of the invention.
Figure 2B:
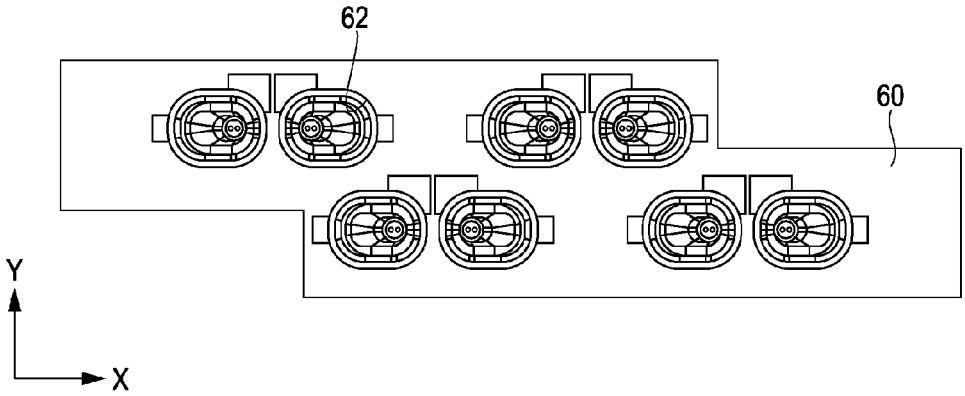
FIG. 2B is a plan view of a flow path member thereof.
Figure 3A:
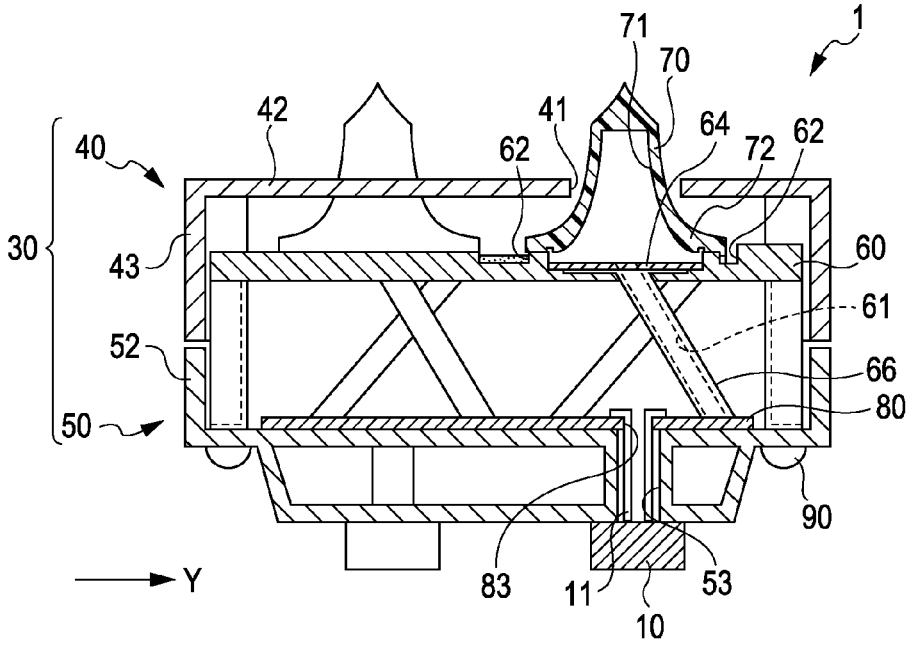
FIG. 3A is a cross-sectional view of the recording head according to Embodiment 1 of the invention.
Figure 3B:
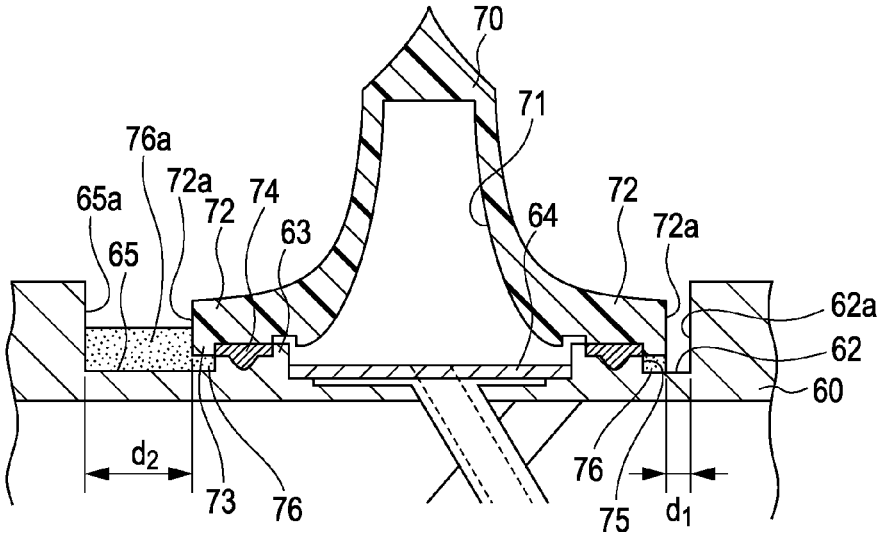
FIG. 3B is an enlarged cross-sectional view of the recording head thereof.

FIG. 1 is an exploded perspective view of an ink jet type recording head which is an example of a liquid ejecting head according to Embodiment 1 of the invention, FIG. 2A is a plan view of the ink jet type recording head, and FIG. 2B is a plan view of a flow path member. FIG. 3A is a cross-sectional view of FIG. 2A cut along a line IIIA-IIIA and FIG. 3B is an enlarged view of FIG. 3A.

As shown in drawings, an ink jet type recording head 1 (hereinafter, simply called "head 1") includes head main bodies 10 which discharge ink drops as liquid, and a flow path member 20 in which the head main bodies 10 are held and liquid flow paths are provided.

The flow path member 20 is provided with a case 30 which has a first case 40 and a second case 50, a flow path member main body 60 which is a second flow path member held in the case 30, ink supply needles 70 which are first flow path members fixed on a surface of the first case 40 side of the flow path member main body 60, and a circuit substrate 80 which is held in the second case 50 side of the flow path member main body 60 in the case 30. The first case 40 and the second case 50 are fixed by fastening material 90 such as a screw as fixing material in a state in which the flow path member main body 60, a part of the ink supply needle 70, and the circuit substrate 80 are held.

The flow path member main body 60 sets a rectangular shape as a standard seen from top view, and has notched shapes of corners which are a pair of opposite angles. A liquid supply path 61 which is a second flow path and whose one end is opened to the first case 40 side and other end is opened to the second case 50 is formed in the flow path member main body 60.

A concave portion 62 is formed in an opening section of the liquid supply path 61 of the first case 40 side on the flow path member main body 60. In other words, the concave portion 62 is provided such that the liquid supply path 61 is opened to the bottom surfaces of the concave portion, that is, a surface of the second case 50 side. The concave portion 62 is formed in a size in which a part of the flow path member main body 60 side of the ink supply needle 70 is inserted. In other words, the concave portion 62 is formed with a larger opening area than a skirt portion 72 of the ink supply needle 70 described in detail later, and has a size in which a predetermined distance $d_1$ between a wall surface 62*a* of the concave portion 62 which faces the ink supply needle 70, and a circumference surface 72*a* of the ink supply needle 70 which is inserted into the concave portions 62 and which faces the wall surface 62*a* is formed when the skirt portion 72 of the ink supply needle 70 is inserted into the concave portions 62.

On the bottom surface of the concave portion 62, that is, the surface where the liquid supply path 61 is opened, a first protruding portion 63 which protrudes from the bottom surface to the ink supply needle 70 side is provided in a circumferential direction of the liquid supply path 61.

A filter 64 to remove bubbles and foreign substances in ink is provided in the first protruding portion 63 of the concave portion 62. The filter 64 can be fixed to the flow path member main body 60 by thermal welding, for example. By fixing the filter 64 to the flow path member main body 60 through the thermal welding in such a manner, when the filter 64 is fixed to the flow path member main body 60 by an adhesive, the adhesive can suppress the filter 64 from clogging.

The ink supply needle 70 which is the first flow path member and a liquid receiving member is fixed in the opening of the liquid supply path 61. A penetration path 71 which is a first flow path to communicate with the liquid supply path 61 is provided in each the ink supply needle 70. A storage unit such as an ink cartridge (not shown) is connected to the ink supply needle 70 directly or through a tube. Due to this, ink from the liquid storage unit is supplied to the liquid supply path 61 through the penetration path 71 of the ink supply needle 70.

In the embodiment, eight liquid supply paths 61 are provided, and the filter 64 and the ink supply needle 70 are provided in the opening section of each liquid supply path 61. In other words, eight ink supply needles 70 are provided in the embodiment. Two of the ink supply needles 70 which are arranged in a first direction X are one set, and two sets of ink supply needles 70 are arranged in the first direction X. Two sets of ink supply needle 70 rows arranged in the first direction X are provided in two rows to a second direction Y orthogonal to the first direction X. Two rows of ink supply needles 70 which are arranged in the second direction Y are arranged in a position where the two rows deviate each other in the first direction X not to have the same position in the first direction X.

As a shape of a tip in the ink supply needle 70, a cuspidal shape or a cylindrical shape in which the tip is not sharp can be employed. However, the shape of the tip in the ink supply needle 70 is not limited to this, and any shape can be employed as long as liquid from the storage unit can be supplied.

With respect to the ink supply needle 70 which is the first flow path member and the flow path member main body 60 which is the second flow path member, the skirt portion 72 side of the ink supply needle 70 is inserted into the concave portions 62 provided on the surface of the first case 40 side of the flow path member main body 60, and the flow path member main body 60 and the ink supply needle 70 are fixed by welding and are adhered by the adhesive.

Specifically, the skirt portion 72 in which the outer diameter of the ink supply needle 70 gradually spreads to the flow path member main body 60 is formed. A second protruding portion 73 which protrudes to the flow path member main body 60 side is provided around the penetration path 71 on the surface of the flow path member main body 60 side of the skirt portion 72.

In the flow path member main body 60 and the ink supply needle 70, a tip portion of a first protruding portion 63 (ink supply needle 70 side) and a tip portion of the second protruding portion 73 (flow path member main body 60 side) are fixed by welding. Due to this, a welding layer 74 is formed between the first protruding portion 63 and the second protruding portion 73.

The outer diameter of the skirt portion 72 in the ink supply needle 70 is larger than the outer diameter of the first protruding portion 63, and when the flow path member main body 60 and the ink supply needle 70 are welded, the outer diameter of the flow path member main body 60 side in the ink supply needle 70 protrudes outside more than the first protruding portion 63 (the outside in the case of setting the liquid supply path 61 side as an inside). A concave groove portion 75 is formed between the bottom surface of the concave portion 62 and the skirt portion 72 which protrudes from the first protruding portion 63 of the ink supply needle 70 around the welding layer 74. An adhesion layer 76 formed with an adhesive is filled in the groove portion 75. That is, the adhesion layer 76 is provided to straddle a boundary between the ink supply needle 70 and the flow path member main body 60 outside the welding layer 74 in the vicinity where the liquid supply path 61 and the penetration path 71 communicate each other.

Due to this, the ink supply needle 70 which is the first flow path member and the flow path member main body 60 which is the second flow path member are fixed by the welding layer 74 welded around a section where with the penetration path 71 which is the first flow path and the liquid supply path 61 which is the second flow path communicate each other, and adhesion layer 76 formed with an adhesive outside a region where the liquid supply path 61 and the penetration path 71 of the welding layer communicate in the circumferential direction.

In such a manner, by being fixed by the welding layer 74 in which the flow path member main body 60 and the ink supply needle 70 are welded and the adhesion layer 76, even when the flow path member main body 60 and the ink supply needle 70 are welded with a relatively low stimulation (low-power ultrasonic waves) from outside to form the welding layer 74, the flow path member main body 60 and the ink supply needle 70 are adhered by the adhesion layer 76 formed with an adhesive to improve adhesive strength. It is possible to suppress adhesive defects and leakage of ink by generating a gap between the flow path member main body 60 and the ink supply needle 70. Incidentally, the storage unit is connected to the ink supply needle 70 directly or through the tube. However, when the storage unit is directly connected to the ink supply needle 70, every time the storage unit is exchanged, the storage unit is put in and taken out of the ink supply needle 70, a strong stress is applied to the ink supply needle 70. Thus, when adhesive strength of the ink supply needle 70 and the flow path member main body 60 is low, the ink supply needle 70 comes off the flow path member main body 60 or a gap is generated at the connecting section and ink leaks out. Even when the tube is connected with the ink supply needle 70, at the time when the ink jet type recording head 1 moves in a main scanning direction, a curve state of the tube changes, and stress is applied to the ink supply needle 70. Furthermore, a concave injecting portion 65 which communicates with the concave portion 62 and is opened to the same surface of the first case 40 side as the concave portion 62 is provided in the flow path member main body 60.

The injecting portion 65 is provided to have a wider distance $d_2$ between the injecting portion 65 and the ink supply needle 70 inserted into the concave portions 62 than the distance $d_1$ between the concave portion 62 and the ink supply needle 70. In other words, when the ink supply needle 70 is fixed in the concave portions 62, the distance $d_2$ between the circumference surface 72*a* of the ink supply needle 70 in the concave portions 62 (the circumference surface facing the wall surface 62*a* of the concave portion 62) and a wall surface 65*a* of the injecting portion 65 is wider in comparison with the distance $d_1$ between the wall surface 62*a* of the concave portion 62 and the circumference surface 72*a* of the ink supply needle 70 in the concave portion 62.

The injecting portion 65, which will be described later in detail, is a section in which an adhesive is injected when the groove portion 75 at the boundary between the ink supply needle 70 and the flow path member main body 60 is filled with the adhesive, and an adhesion layer 76*a* formed with an adhesive is formed in the injecting portion 65. The adhesion layer 76*a* is provided to be successive to the adhesion layer 76 filled in the groove portion 75. The adhesion layer 76*a* filled in the injecting portion 65 is filled up to the position which is higher than the groove portion 75 (the first case 40 side), but the adhesion layer 76*a* is filled in the height not to reach the surface of the first case 40 side of the ink supply needle 70.

At least two or more injecting portions 65 are provided in each concave portion 62 in the embodiment. In the embodiment, two injecting portions 65 are provided at the position where the injecting portions pinch the concave portion 62 as a center so as to be approximately symmetrical, that is, at the position to be the opposite angle of the concave portion 62. Therefore, when the adhesive is injected from the injecting portion 65, it is possible to certainly fill the groove portion 75 with the adhesive in a circumferential direction of the ink supply needle 70. A number and the position of the injecting portion 65 are not particularly limited, and one injecting portion 65 or three or more injecting portions 65 may be provided.

The volume of the injecting portion 65 is larger than the volume of the adhesion layer 76 provided in one groove portion 75. Due to this, even when the adhesive with an amount capable of filling the groove portion 75 is injected into the injecting portion 65, it is possible to suppress the adhesive from overflowing from the injecting portion 65.

Each tubular flow path forming portion 66 in which the liquid supply path 61 is formed is drilled in the other surface opposite to the ink supply needles 70 in the flow path member main body 60 in which the ink supply needles 70 are fixed on one surface and the circuit substrate 80 is formed between the flow path forming portion 66 and the second case 50.

On the other hand, the first case 40 has an approximately box-like shape in which the second case 50 side is opened, and has a plate-like first base portion 42 where window portions 41 in which the ink supply needles 70 are exposed are provided in a region which the ink supply needles 70 face and first side walls 43 which protrude to the second case 50 side over the periphery of the first base portion 42.

One window portion 41 is provided in each set of two ink supply needles 70 arranged in the first direction X. The window portion 41 may have a size exposing the tips of the ink supply needles 70, and when the size of the window portion is too large, there is a concern that foreign substances may intrude into the case. Therefore, the window portion 41 has the minimum necessary size.

The first case 40 comes into close contact with the surface opposite to the flow path member main body 60 of the ink supply needles 70 through a sealing member such as rubber (not shown). Such sealing member is provided around the window portion 41 to suppress the ink from intruding into the flow path member 20 from the window portion 41. That is, by providing the sealing member to seal between the ink supply needles 70 and the first case 40 around the window portion 41, it is possible to suppress the leaked ink from intruding into the flow path member 20 when the ink supply needles 70 are put in and taken out of the ink cartridge and the tube.

As shown in FIG. 1, wiring connections 44 which penetrate the first base portion 42 are provided in a region of the first base portion 42 in the first case 40 facing entries 82 of connectors 81 provided on the circuit substrate 80 held in the first case. Wiring from outside (external wiring) is connected to the connectors 81 of the circuit substrate 80 held in the case through the wiring connections 44 of the first case 40.

Though not specifically shown in the drawing, circuit substrate 80 is made of a plate-like member where electronic parts and various kinds of wiring to drive a pressure generating unit provided in the head main body 10 are mounted. As shown in FIG. 1, connection holes 83 which are penetrated in a thickness direction are provided on the circuit substrate 80. Driving wiring 11 of the head main body 10 is inserted into the connection hole 83, the tip of the driving wiring is folded along the surface of the circuit substrate 80 and electrically connected to various wiring of the circuit substrate 80 and the like.

The circuit substrate 80 has a rectangular shape as seen from top view (visualized from the first case 40 side), and each connector 81 is provided in the corners which are a pair of opposite angles. The connectors 81 are electrically connected to various wiring provided in the circuit substrate 80, and the entries 82 to which the external wiring is connected are fixed so as to be opened to the first case 40 side. Since the flow path member main body 60 makes a region facing the region where the connectors 81 of the circuit substrate 80 are provided (corners to be a pair of opposite angles) in a notched shape, the entries 82 of the connectors 81 in the circuit substrate 80 are exposed in the wiring connections 44 of the first case 40 to connect the external wiring such as a flexible flat cable (FFC) to the entries 82 of the connectors 81.

The circuit substrate 80 is held between the flow path member main body 60 and the second case 50. The size of the circuit substrate 80 is smaller than the outer circumference of the flow path member main body 60 as seen in plan view from the first case 40 side.

The second case 50 has a second base portion 51 which has a rectangular shape as seen from top view (visualized from the first case 40), and second side walls 52 which are provided on the long sides of the second base portion as seen from top view of the second base portion 51, and protrude from the second base portion 51 to the first case 40.

The plural head main bodies 10 are fixed on the surface opposite to the first case 40 of the second base portion 51 of the second case 50. Each insertion hole 53 which penetrates the second base portion 51 in the thickness direction is provided in the second base portion 51 of the second case 50 to correspond each head main body 10. The driving wiring 11 of the head main body 10 held in the second case 50 penetrates the insertion hole 53, and is connected to the circuit substrate 80. As shown in FIG. 1, a supply communication path 54 whose one end side is connected to the liquid supply path 61 of the flow path member main body 60 is provided around the insertion hole 53 of the second base portion 51. By connecting other end of the supply communication path 54 to the flow path of the head main body 10 (not shown), ink from the liquid supply path 61 is supplied to the head main body 10 through the supply communication path 54. The supply communication path 54 is practically connected to the liquid supply path 61 of the flow path member main body 60 through flow path 84 provided on the circuit substrate 80. At this time, when a sealing member made of an elastic member such as rubber is provided in the section where the liquid supply path 61, the flow path 84, the supply communication path 54, the flow path of the head main body 10 (not shown), and the like are connected each other, ink leakage from the connecting section of each flow path can be suppressed.

The flow path member 20 is loaded with the circuit substrate 80 on one surface side of the second case 50, and the head main bodies 10 are fixed on other surface side of the second case 50. The driving wiring 11 of the head main bodies 10 and the circuit substrate 80 are electrically connected to each other. Then, the first case 40 and the second case 50 are fixed by the fastening material 90 in a state in which the first case 40 and the flow path member main body 60 in which the ink supply needles 70 are fixed overlap each other from the ink supply needle 70 side, and the circuit substrate 80 is pinched between flow path member main body 60 and the second case 50. Due to this, the first case 40 and the second case 50 are integrated to form the case 30, and the flow path member main body 60 where the ink supply needles 70 are fixed and the circuit substrate 80 are held in the case 30 to form the integrated flow path member 20.

At this time, the first side walls 43 of the first case 40 and the second side walls 52 of the second case 50 form outer wall of the case 30. The first side walls 43 and the second side walls 52 are positioned in a state in which a predetermined gap between the tip surfaces which faces each other is formed, as shown in FIG. 3A. When ink from between the first side walls 43 and the second side walls 52 tries to intrude into a gap between the first side walls 43 and the second side walls 52, the gap forms a meniscus with the ink and the suppress the ink from intruding from the gap. The tip surfaces of the first side walls 43 and the second side walls 52 may be come into close contact with each other, and an elastic member such as rubber (a sealing member) may be pinched between the tip surfaces of the first side walls 43 and the tip surfaces of the second side walls 52 to suppress the ink from intruding. Furthermore, a boundary between the first side walls 43 and the second side walls 52 may be sealed with resin and the like.

The plural head main bodies 10 are fixed in the flow path member 20 of the embodiment as described above. For example, the nozzle openings (not shown) are arranged in the first direction X in the head main bodies 10 and the plural head main bodies 10 are arranged in zigzag to the first direction X which is the arranged direction of the nozzle openings. Therefore, it is possible to form lengthy nozzle rows in the first direction X which are the arranged direction of the nozzle openings with the same pitch. Herein, "the plural head main bodies 10 are arranged in zigzag" means that the plural head main bodies 10 are arranged in the first direction X which is the arranged direction of the nozzle openings and the rows which are formed with the plural head main bodies 10 arranged in the first direction X are arranged in the second direction Y across to the first direction X as shown in FIG. 1. Two rows of head main bodies 10 arranged in the second direction Y face the first direction X each other and are arranged in the position deviated as much as a half pitch of the pitch of the head main bodies 10 arranged in the first direction X. the head main bodies 10 adjacent to the two rows of head main bodies 10 are provided so that the nozzle openings in the end side of the nozzle rows in one side row of the head main bodies 10, and the nozzle openings in the end side of the nozzle rows in other side row of the head main bodies 10 are in the same position in the first direction X of the nozzle openings. Due to this, the plural head main bodies 10 makes it possible to arrange the nozzle openings along the first direction X with the same pitch as much as the plural head main bodies 10 to make the nozzle rows successive and to discharge ink to a wide medium to be recorded over a wide area with the width of the successive nozzle rows.

Figure 4A:
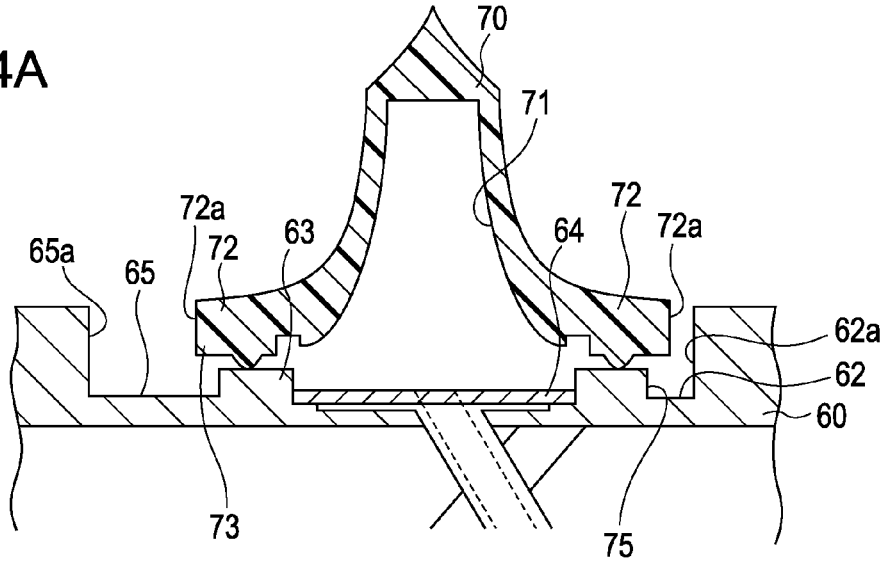
FIGS. 4A to 4C are main part cross-sectional views showing a method of manufacturing a recording head according to Embodiment 1.
Figure 4B:
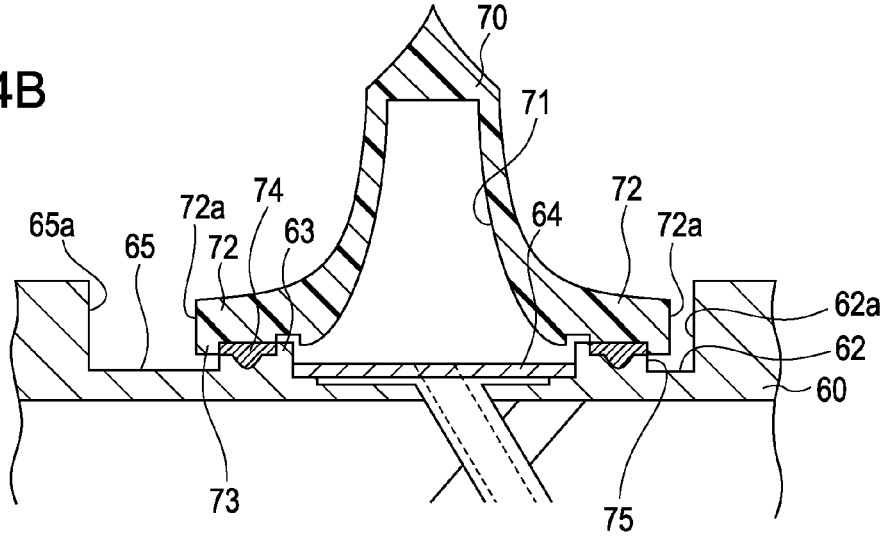
Figure 4C:
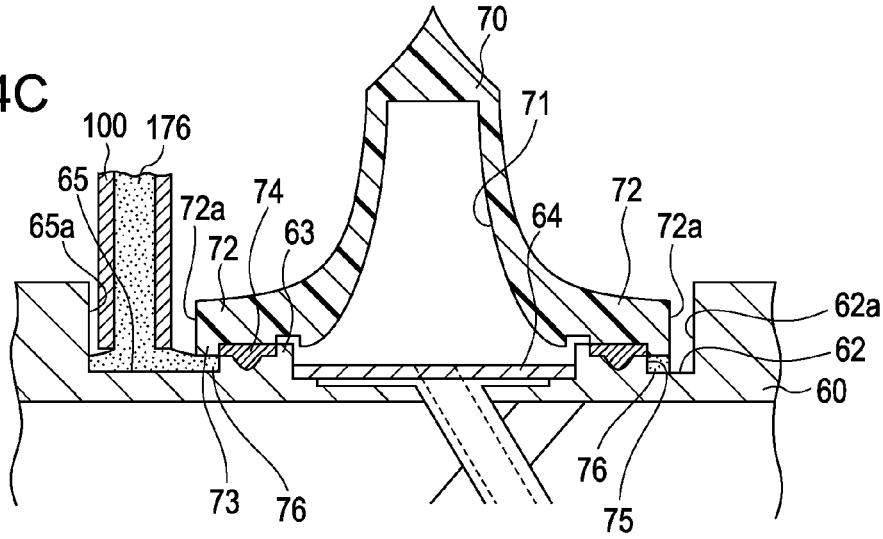

Herein, a method of manufacturing a flow path member 20 used in the ink jet type recording head 1 will be described. FIGS. 4A to 4C are cross-sectional views showing the method of manufacturing a flow path member.

As shown in FIG. 4A, the ink supply needle 70 is inserted into the concave portions 62 of the flow path member main body 60. In the embodiment, the first protruding portion 63 of the flow path member main body 60 and the second protruding portion 73 of the ink supply needle 70 are come into close contact with each other.

As shown in FIG. 4B, the flow path member main body 60 and the ink supply needle 70 are welded. Specifically, a horn for ultrasonic welding touches the skirt portion 72 of the ink supply needle 70 (the opposite surface of the flow path member main body 60) and ultrasonic vibration is applied from the horn. Due to this, a part of the first protruding portion 63 and the second protruding portion 73 melts and the welding layer 74 is formed. The flow path member main body 60 and the ink supply needle 70 are welded by the welding layer 74. The ultrasonic vibration to perform the welding has lower power than the ultrasonic vibration when the flow path member main body 60 and the ink supply needle 70 are fixed only by welding.

Since the flow path member main body 60 and the ink supply needle 70 are welded by the relatively low-power ultrasonic vibration, it is possible to reduce the amount of foreign substances generated by relatively high-power ultrasonic welding. That is, when the ultrasonic vibration is performed with high power, an amount of foreign substances that increases with the amount of energy is generated due to the vibration and the clogging of the filter 64 and the foreign substances flow into the head main body 10. Therefore, there is a concern the nozzle opening clogging and the like may be generated. In the embodiment, by performing the ultrasonic welding with relatively low power, it is possible to suppress the filter 64 and the nozzle openings from clogging by generating foreign substances.

As shown in FIG. 4C, a syringe 100 to inject an adhesive 176 is inserted into the injecting portion 65, and the adhesive 176 is injected from the syringe 100 into the injecting portion 65. The adhesive 176 attached to the groove portion 75 is filled in the groove portion 75 by a capillary phenomenon. The injected and filled adhesive 176 is hardened and the adhesion layer 76 (76*a*) is formed to adhere the flow path member main body 60 and the ink supply needle 70. The adhesive 176 also is filled in the gap of the welding layer 74 by a capillary phenomenon, and functions as a sealing to seal the welding layer 74.

In such a manner, it is possible to suppress the syringe 100 from contacting the surface of the first case 40 side of the ink supply needle 70 to attach the adhesive 176 to the surface of the first case 40 side of the ink supply needle 70 by inserting the syringe 100 into the injecting portion 65 to fill the groove portion 75 with the adhesive 176 in comparison with a method that the syringe 100 moves in a circumferential direction of the concave portion 62 to apply the adhesive 176. In other words, when the syringe 100 moves in the circumferential direction of the concave portion 62 to apply the adhesive 176, since the syringe 100 is moved, there is a high possibility that the syringe 100 is attached to the ink supply needle 70 at an unintended timing due to carelessness and operation errors. When the adhesive 176 is attached to the surface of the first case 40 side of the ink supply needle 70, there is a concern that the storage unit and the tube may not be connected to the ink supply needle 70, and the first case 40 cannot be fixed at a predetermined height by the adhesive 176 to which the first case 40 is attached to generate defects that the ink intrudes from a gap between the first case 40 and the ink supply needle 70 and from gaps on the outer wall of the case 30. In the embodiment, since the syringe 100 is inserted into the injecting portion 65 at the position apart from the concave portion 62 to be filled with the adhesive 176, it is possible to suppress that the syringe 100 contacts the ink supply needle 70 at an untended timing and the adhesive 176 is attached to the first case 40 of the ink supply needle 70. As a result, it is possible to suppress the storage unit and the tube from not being connected to the ink supply needle 70 by the attached adhesive 176, and to suppress defects that the ink intrudes from the gap between the first case 40 and the ink supply needle 70, and from the gaps the outer wall of the case 30. When the ink intrudes into the flow path member 20 from other than the flow path, since the circuit substrate 80 is held in the flow path member 20, a defect that electronic parts are broken by the intruded ink is generated.

In the embodiment, the syringe 100 is inserted into the injecting portion 65, and fills the groove portion 75 with the adhesive 176 to simplify applying the adhesive 176 and reduce working hours in comparison with the syringe 100 moves in the circumferential direction of the concave portion 62 to apply the adhesive 176.

Furthermore, since the flow path member main body 60 and the ink supply needle 70 are fixed by the welding and the adhesive in the embodiment, adhesive strength can be improved to suppress the ink leakage from the boundary between the flow path member main body 60 and ink supply needle 70 even when the flow path member main body 60 and the ink supply needle 70 are fixed by relatively weak welding.

Other Embodiment

Herein, an embodiment of the invention has been described, but a basic configuration of the invention is not limited to the above-described. For example, the head 1 which includes the flow path member 20 in which the circuit substrate 80 is held is exemplified in Embodiment 1 describe above, but is not particularly limited to this. The circuit substrate 80 may not be held in the flow path member 20. When the circuit substrate 80 is not held in the flow path member 20, there are problems that the ink drops on the medium to be recorded at an unexpected timing and contaminates the medium to be recorded as the ink intrudes into the flow path member 20. However, as described above, it is possible to improve rigidity by forming the outer wall with the first side walls 43 and the second side walls 52. Therefore, it is possible to suppress the ink from intruding into the case 30 and to suppress the medium to be recorded from contaminating. A valve which maintains the pressure of the downstream side of the flow path constant in the flow path member 20 may be provided or other parts and functions may be held.

Figure 5:
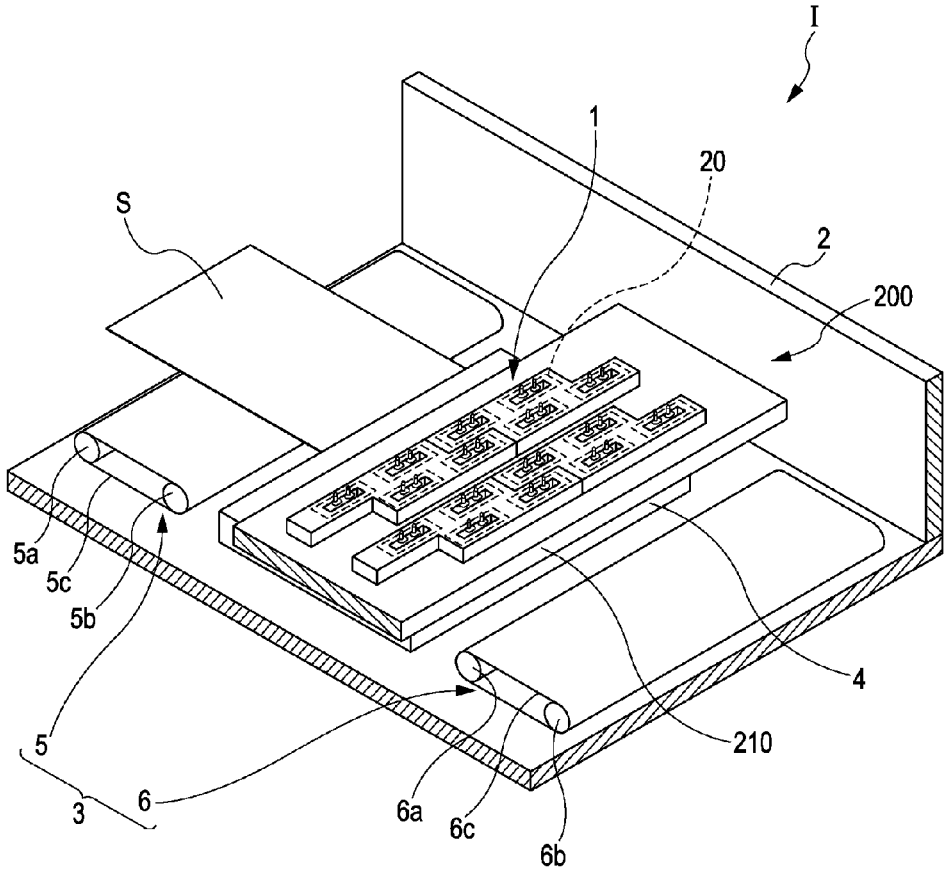
FIG. 5 is a schematic perspective view of a recording apparatus according to an embodiment of the invention.

As shown in FIG. 5, the head 1 of each embodiment described above is fixed by fixing members in plural (for example, four heads in the embodiment) to form an ink jet type recording head module 200 (hereinafter, called "head module 200") which is an example of a liquid ejecting head module. The head module 200 is mounted to an ink jet type recording apparatus which is an example of a liquid ejecting apparatus. Here, the ink jet type recording apparatus of the embodiment will be described. FIG. 5 is a schematic perspective view showing the ink jet type recording apparatus which is an example of the liquid ejecting apparatus according to Embodiment 1 of the invention.

As shown in FIG. 5, the ink jet type recording apparatus of the embodiment is a so-called line type recording apparatus in which the head module 200 is fixed and transports a recording sheet S such as paper which is the medium to be recorded to perform printing.

Specifically, an ink jet type recording apparatus I includes an apparatus main body 2, the head module 200 which is fixed in the apparatus main body 2, a transporting unit 3 to transport the recording sheet S which is the medium to be recorded, and a platen 4 to support a back surface side opposite to a printing surface facing the head module 200 of the recording sheet S.

The transporting unit 3 has a first transporting unit 5 which is provided in both sides of a transport direction of the recording sheet S to the head module 200, and a second transporting unit 6.

The first transporting unit 5 has a driving roller 5*a*, a driven roller 5*b*, and a transport belt 5*c* in which the driving roller 5*a* and a driven roller 5*b* are wound. The second transporting unit 6 has a driving roller 6*a*, a driven roller 6*b*, and a transport belt 6*c* like the first transporting unit 5.

The respective driving rollers 5*a* and 6*a* of the first transporting unit 5 and the second transporting unit 6 are connected to a driving unit such as a driving motor (not shown), and the transport belts 5*c* and 6*c* are rotatably driven by the driving unit to transport the recording sheet S to the upstream side and the downstream side of the head module 200.

In the embodiment, the first transporting unit 5 and the second transporting unit 6 which are formed with the driving rollers 5*a* and 6*a*, the driven rollers 5*b* and 6*b*, and the transport belts 5*c* and 6*c* are exemplified, but a holding unit which holds the recording sheet S on the transport belts 5*c* and 6*c* may be further provided. As the holding unit, for example, a charging unit which charges a circumference surface of the recording sheet S may be provided, and the recording sheet S charged by the charging unit may be adsorbed onto the transport belts 5*c* and 6*c*. The holding unit may be provided with press rollers on the transport belts 5*c* and 6*c* to pinch the recording sheet S between the press rollers and the transport belts 5*c* and 6*c*.

The platen 4 is made of metal and resin which is provided to face the head module 200 and have a rectangular cross section between the first transporting unit 5 and the second transporting unit 6. The platen 4 supports the recording sheet S transported by the first transporting unit 5 and the second transporting unit 6 at the position where the recording sheet S faces the head module 200.

An adsorbing unit to adsorb the transported recording sheet S on the platen 4 may be provided in the platen 4. As the adsorbing unit, for example, there are an adsorbing unit which performs suction and adsorbing by sucking the recording sheet S, and an adsorbing unit which electrostatically adsorbs the recording sheet S with electrostatic force.

The store unit such as an ink tank and an ink cartridge which stores the ink and is not shown in drawing is connected to supply the ink in the head module 200. The storage unit may be held on the head module 200, for example, or may be connected to the ink supply needles in each head 1 through the tube and the like held at the position different from the head module 200 in the apparatus main body 2. Furthermore, the external wiring (not shown) is connected to each head 1 in the head module 200.

The recording sheet S is transported by the transporting unit 3 in the ink jet type recording apparatus I, and printing is performed on the recording sheet S which is supported on the platen 4 by the head module 200. The printed recording sheet S is transported by the transporting unit 3.

In the example shown in FIG. 5, the heads 1 (head module 200) is fixed in the apparatus main body 2, and the so-called line type ink jet type recording apparatus I which performs printing just by transporting the recording sheet S is exemplified. However, the invention is not particularly limited to this. For example, the invention can be applied to a so-called serial type recording apparatus in which the heads 1 (head module 200) are loaded on the cartridge which moves in the main scanning direction across to the transport direction of the recording sheet S and as the heads 1 (head module 200) move in the main scanning direction, printing is performed.

A member which corresponds to the above-described flow path member 20 may be provided in a different place from the head main body 10 of the ink jet type recording apparatus I. That is, the above-described flow path member 20 is not limited to be used with the head main body 10 to form the ink jet type recording head 1 and may be provided other region such as in the middle of connecting the ink tank and the head main body 10 of the ink jet type recording apparatus I.

In the embodiment, the ink jet type recording head has been described as an example of a liquid ejecting head. However, the invention can be widely applied not only to every kind of liquid ejecting heads, but also to liquid ejecting heads which ejects liquid other than ink. As other liquid ejecting head, various kinds of recording heads used in image recording apparatuses such as a printer, color material ejecting heads used for producing color filters of liquid crystal displays or the like, electrode material ejecting heads used for forming electrodes of organic EL displays, field emission displays (FEDs), or the like, and bio-organic material ejecting heads used for producing bio-chips can be exemplified.

The flow path member used in the liquid ejecting head represented as the ink jet type recording head 1 is described in the above-described embodiment. However, the flow path member in the invention is not limited to liquid ejecting heads and liquid ejecting apparatuses, and can be applied to flow path members used in other devices.

The entire disclosure of Japanese Patent Application No. 2011-162619, filed Jul. 25, 2011 is incorporated by reference herein.

What is claimed is:

1. A flow path member comprising:

a first flow path member which has a first flow path; and a second flow path member which has a second flow path communicating with the first flow path;

a wall provided on and protruded from a circumference of the second flow path member, the wall defining a circumferential concave portion in which the first flow path member is fixed with a gap in a circumferential direction between the wall of the second flow path member and a skirt of the first flow path member facing the wall;

an injecting portion provided in the circumferential concave portion of the second flow path member, the injection portion having a concave shape communicating with the circumferential concave portion and having a widened gap, which is wider than the gap, in the circumferential direction, and wherein the first flow path member and the second flow path member are welded in the circumferential direction and are adhered by an adhesive outside the welded region in the circumferential concave portion.

2. The flow path member according to claim 1, wherein the volume of the injecting portion is larger than the volume of the adhesive.

3. A liquid ejecting head comprising the flow path member according to claim 2.

4. A liquid ejecting apparatus comprising the flow path member according to claim 2.

5. The flow path member according to claim 1, wherein the injecting portion is provided at a position where a region where the first flow path member and the second flow path member are welded each other is set as the center to be symmetrical.

6. A liquid ejecting head comprising the flow path member according to claim 5.

7. A liquid ejecting apparatus comprising the flow path member according to claim 5.

8. A liquid ejecting head comprising the flow path member according to claim 1.

9. A liquid ejecting apparatus comprising the flow path member according to claim 1.

10. The flow path member according to claim 1, further comprising:

a rib that is provided in the circumferential concave portion of the second flow path member, wherein an outer diameter of the skirt of the first flow path member adjacent to the circumferential concave portion of the second flow path member is larger than an outer diameter of the rib, and the skirt of the first flow path member is welded and adhered to a top surface of the rib to define the first flow path.

* * * * *